US005797169A

United States Patent [19]

Donner et al.

[11] Patent Number: 5,797,169

[45] Date of Patent: Aug. 25, 1998

[54] COUPLING PIECE FOR THE DETACHABLE CONNECTION OF CONTAINERS

[75] Inventors: Julius Donner, Lemwerder; Thomas Niemann, Delmenhorst; Wilhelm Wilk, Bremen, all of Germany

[73] Assignee: MacGregor-Conver GmbH, Bremen, Germany

[21] Appl. No.: 776,532

[22] PCT Filed: Aug. 2, 1995

[86] PCT No.: PCT/EP95/03072

§ 371 Date: Apr. 9, 1997

§ 102(e) Date: Apr. 9, 1997

[87] PCT Pub. No.: WO96/06027

PCT Pub. Date: Feb. 29, 1996

[30] Foreign Application Priority Data

Aug. 19, 1994 [DE] Germany ..... 44 29 358.5
Feb. 13, 1995 [DE] Germany ..... 195 04 633.1

[51] Int. Cl.[6] ..... B65D 90/00

[52] U.S. Cl. ..... 24/287

[58] Field of Search ..... 410/82; 24/287, 24/265 CD, 592–595

[56] References Cited

FOREIGN PATENT DOCUMENTS

| | | |
|---|---|---|
| 354332 | 2/1990 | European Pat. Off. . |
| 406652 | 1/1991 | European Pat. Off. . |
| 2443554 | 3/1976 | Germany . |
| 3642399 | 6/1988 | Germany . |
| 3710419 | 10/1988 | Germany . |
| 3990084 | 12/1989 | Germany . |
| 4133498 | 4/1993 | Germany . |
| WO92/05093 | 4/1992 | WIPO . |

*Primary Examiner*—James R. Brittain
*Attorney, Agent, or Firm*—Sughrue, Mion, Zinn, Macpeak & Seas, PLLC

[57] ABSTRACT

The invention relates to a coupling piece for the detachable connection of corner fittings of adjacent containers, especially of containers stacked one above the other on board ships.

In order to reduce the manual effort involved in coupling together containers, semi-automatic coupling pieces are known which only need to be manually attached to one container and pre-locked. A full locking after the containers have been placed one on top of the other is effected automatically. Coupling pieces of this type require however, in many respects, a complex automatic actuating mechanism.

In order to simplify the automatic actuating mechanism, a plurality of stop faces (43, 44 and 45) are provided, which are offset to one another on the locking bolt (21) and which can be brought alternately into a corresponding position to a stop face (54) on a spring-loaded ram (23). The contact of a stop face (43, 44 or 45) of the locking bolt (21) against the stop face (54) of the spring-loaded ram (23) enables the locking bolt to be fixed simply and reliably in the respectively intended position of its crossbolts (32, 33).

3 Claims, 15 Drawing Sheets

COUPLING PIECE FOR THE DETACHABLE CONNECTION OF CONTAINERS

BACKGROUND OF THE INVENTION

The invention relates to a coupling piece for the detachable connection of corner fittings of adjacent containers, especially of containers stacked one above the other on board ships, according to the preamble of claim 1.

Coupling pieces of the type stated at the beginning are usually referred to in the jargon of the trade as "twistlocks". These coupling pieces are predominantly used in the transport containers on board ships. With the coupling pieces, the containers are connected one to another and to the ship. Relative displacements of the containers during marine transport are thereby intended to be prevented.

In order to reduce the lay times of the ships in connection with the loading and unloading of containers, semi-automatically working coupling pieces are used. These minimize the manual activities involved in locking and unlocking the coupling pieces.

By way of example, a semi-automatic coupling piece is known from DE 37 10 419 A1. In this coupling piece, the locking bolt can be actuated both manually and by a pre-tensioned spring. Consequently, the coupling piece only needs to be manually coupled to one container. This is realized by the respective coupling piece being pre-locked to a container, whereupon the spring serving the subsequent automatic twisting of the locking bolt is simultaneously pretensioned. Following manual pre-locking, the containers to be connected are placed one on top of the other and the coupling piece is automatically thereupon locked by virtue of the pretensioned spring.

This known coupling piece demands a very complex spring mechanism and a twistable actuating lever. In addition, the spring mechanism and the twistable actuating lever lead to functional impairments in the known coupling piece. In particular, the locking bolt, in its relative position to the housing which is necessary for the intended operation of the coupling piece, cannot or cannot accurately be fixed.

SUMMARY OF THE INVENTION

Starting from this basis, the object of the invention is to refine a coupling piece of the type stated at the beginning such that it has a simple structure and is functionally reliable.

For the achievement of this object, the coupling piece according to the invention displays the features defined in claim 1. The pressure element assigned to the locking bolt and at least one stop means both on the locking bolt and on the pressure element produce the effect that a stop means on the locking bolt comes to bear against a corresponding stop means of the pressure element and consequently the locking bolt with the crossbolts is able to be reliably fixed in a certain relative position to the housing. On the middle part of the crossbolt there can be disposed an optional number of stop means, which number is chosen such that each relative position which occurs in practice of the crossbolts to the housing is assigned a stop means. As a minimum, two stop means are assigned to the locking bolt. Where the locking bolt displays a plurality of stop means, the pressure element needs only to display one (single) stop means. It is alternatively conceivable to dispose on the pressure element a plurality of stop means, whilst the middle part displays only one (single) stop means.

The stop means are preferably configured such that, if they are not located in their corresponding relative position to one another in which the crossbolts are fixed, they make their way automatically into such a position when the locking bolt with the crossbolts is twisted. It is thereby ensured that the locking bolt makes its way automatically into a position in which a reliable fixing of the crossbolt is secured against further twisting.

By way of example, this can relate to the locking position (with both locked crossbolts), the pre-locking position (with only one locked crossbolt) and the unlocked position (with a different unlocked crossbolt).

The automatic twisting of the locking bolt into the respective position is effected, in a preferred embodiment of the invention, by the pressure element, which, under the action of a spring, forces the stop means assigned to it against the middle part of the locking bolt and thereupon twists this in such a way that the corresponding stop means on the middle part makes its way into the corresponding position to the stop means on the pressure element.

In a preferred embodiment of the invention, the stop means are configured as stop faces. For the fixing of the locking bolt in the respective setting of the crossbolts, the flat or profiled stop faces correspond with one another in such a way that the respective stop face on the locking bolt bears essentially full-face against the stop face of the pressure element. In the fixing position, the corresponding stop faces thus lie against from one another in parallel-running arrangement, whereas the free stop faces lie in different planes to the stop face which presently corresponds with the stop face of the pressure element.

A further feature of the invention relates to the fact that the pressure element displays a guide which is mounted in longitudinally displaceable arrangement in the housing. The length of the guide is dimensioned such that this, in a certain position of the locking bolt, particularly in the locking setting of the coupling piece, is located fully in the housing; by contrast, in the other settings of the locking bolt, part of the guide juts out of the housing. The guide, which can be configured as a guide rod, a guide tube or a guide tongue, thereby acts as an indicator which indicates whether the coupling piece is properly locked.

In a refinement of the invention, an actuating means is configured flexibly such that it is deformable, i.e. bendable, about its longitudinal axis, yet, in addition to tensile forces, can also transmit compression forces. In this way, the locking bolt with the crossbolts can be twisted by the actuating means in opposite directions, thereby making the actuating means suitable for locking and unlocking the coupling piece.

It is alternatively envisaged to pretension the locking bolt by means of a spring such that the spring enables the locking bolt to be twisted into its unlocking position. In this case, the actuating means is configured only to transmit tensile forces. It can be fixed at least in the locking position of the coupling piece in order that the spring pretensioning which is then in force does not rotate the locking bolt back into the unlocked position. It is only once the fixing of the actuating means is released that, as a result of the spring pretensioning of the spring, the locking bolt is rotated back into the unlocked position of the coupling piece.

A further alternative illustrative embodiment of the invention provides for a reset element, which is preferably configured as a second actuating means. Both actuating means need to be configured only for the transmission of tensile forces. Whilst, by virtue of the first actuating means, the locking bolt is twisted into the locking position of the coupling piece, the second actuating means or reset element serves to rotate the locking bolt back in the opposite direction, namely into the unlocked position of the coupling piece.

BRIEF DESCRIPTION OF THE DRAWING

Preferred illustrative embodiments of the invention are explained in greater detail below with reference to the drawing, in which.

DESCRIPTION OF PREFERRED EMBODIMENTS

The coupling piece which is shown here serves the semi-automatic connection of containers stacked one on top of the other, which are not represented in the figures. The coupling piece is composed of a housing 20, a locking bolt 21, an actuating means 22 and a spring-loaded ram 23.

Figure 1:
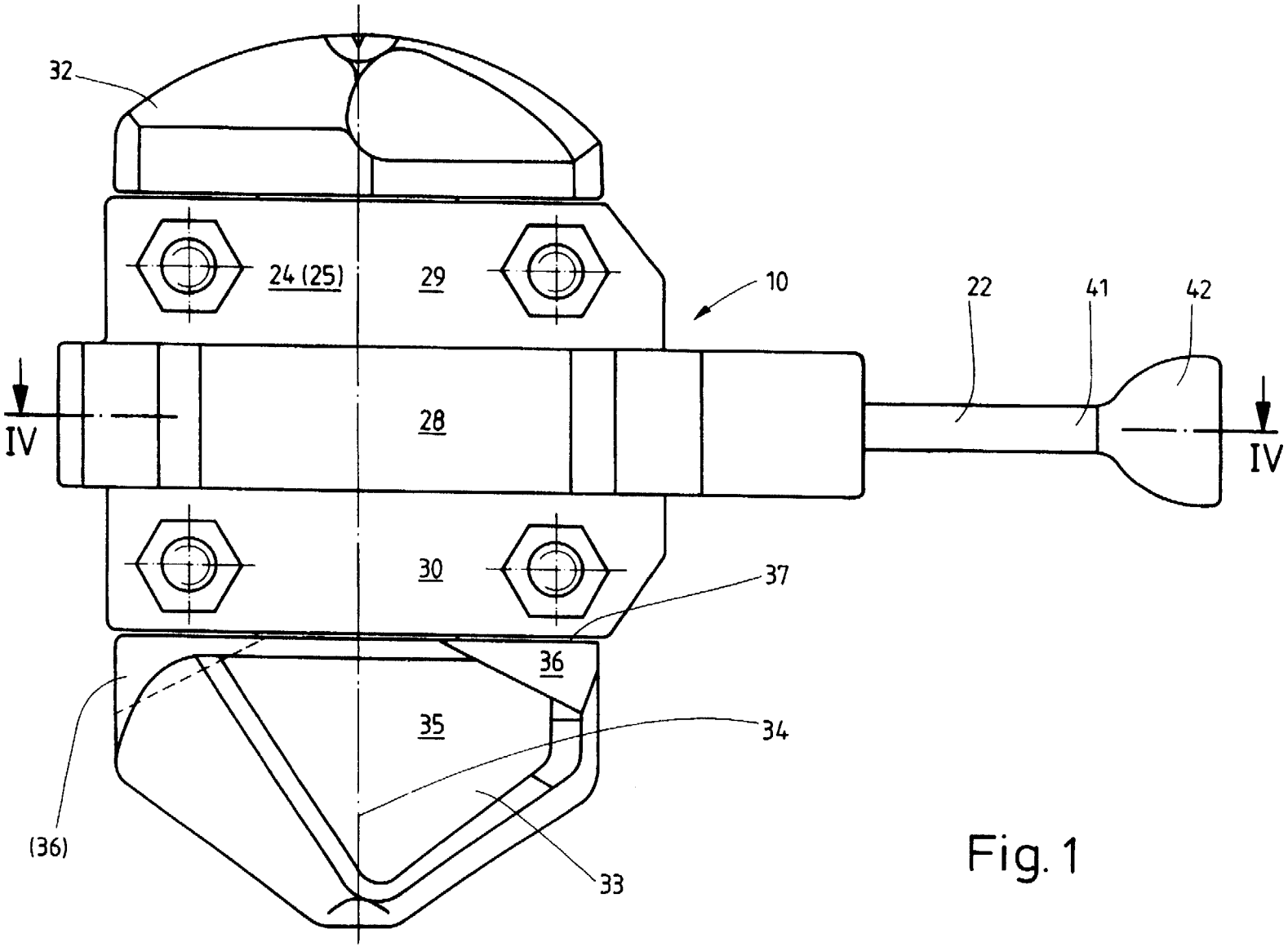
FIG. 1 shows a side view of a coupling piece.

The housing 20 of the coupling piece shown is configured in two parts. It is formed of two housing halves 24 and 25. The housing halves 24 and 25 are screwed together at a central partition plane 26. The partition plane 26 runs longitudinally through the middle of a through-bore 27 in the housing 20. The partition plane 26 and the through-bore 27 run, in relation to that usage position of the coupling piece represented in FIG. 1, vertically through the housing 20. The outer part of the housing 20 is divided into three portions, namely into a central counter-bearing 28, which, when containers are stacked one on top of the other, comes to lie between adjacent corner fittings of the containers as a spacer, and two middle pieces 29 and 30 disposed on opposite sides of the counter-bearing 28, which jut into corresponding long holes in respectively opposing corner fittings of the containers.

Figure 2:
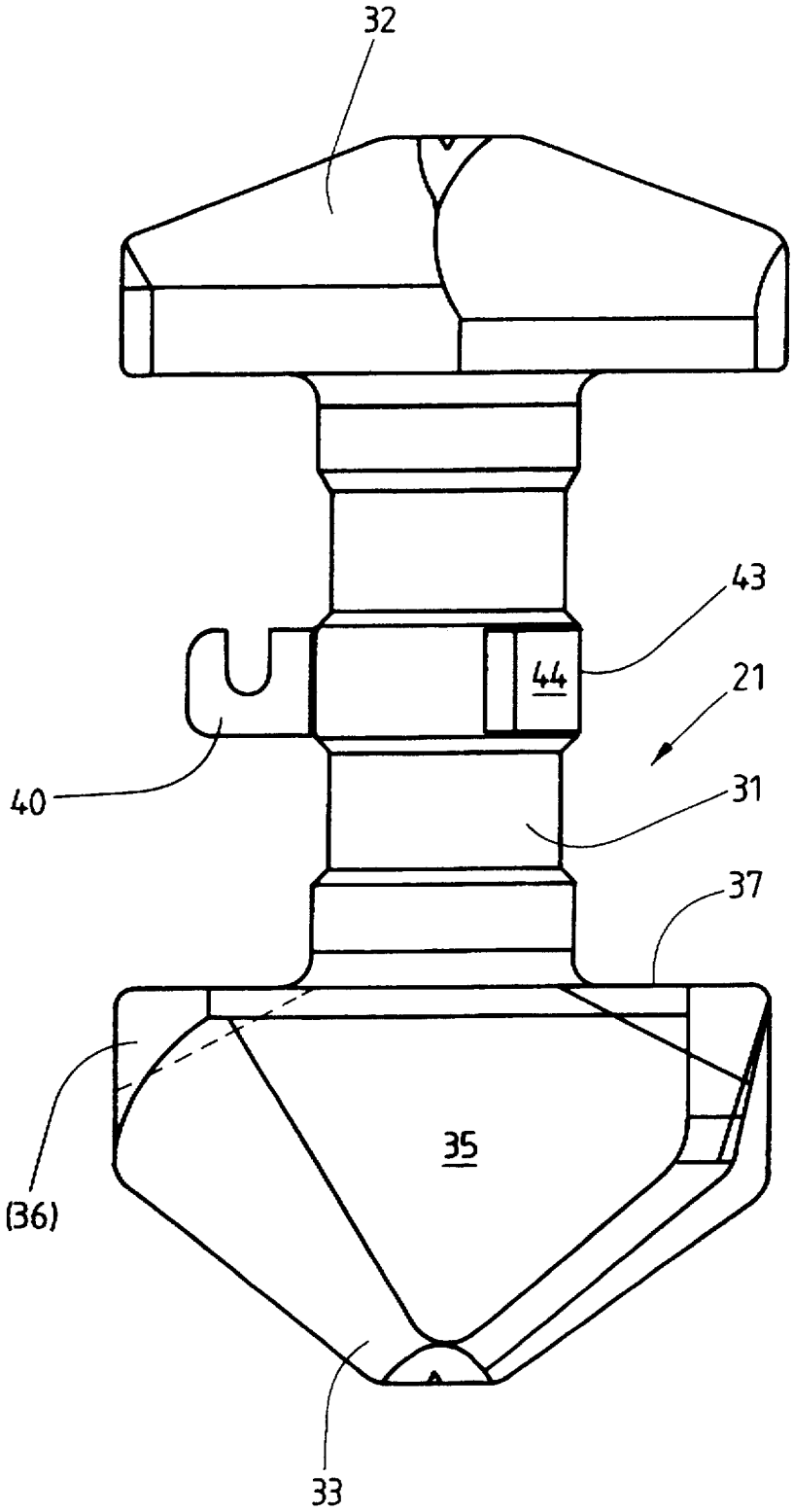
FIG. 2 shows a side view of a locking bolt of the coupling piece.

The locking bolt 21 represented in FIG. 2 is composed of an essentially cylindrical middle part 31 and two crossbolts 32 and 33. The crossbolts 32 and 33 are formed in one piece onto opposite ends of the middle part 31. With the middle part 31, the locking bolt 21 is mounted rotatably in the through-bore 27 of the housing 20, to be precise about its longitudinal centre axis 34. The two crossbolts 32 and 33 jut out of opposite ends of the housing 20. They are herein located above the respective middle piece 29 and 30 on the housing 20. The cross-sectional dimensions of the crossbolts 32 and 33 are chosen such that, in certain positions of the locking bolt 21, in each case only one crossbolt 32 or 33 can essentially be brought into convergence with the surface of one of the middle pieces 29 and 30. To this end, the crossbolts 32 and 33 are offset one to another, this offset preferably measuring between 70° and 90°.

Figure 3:
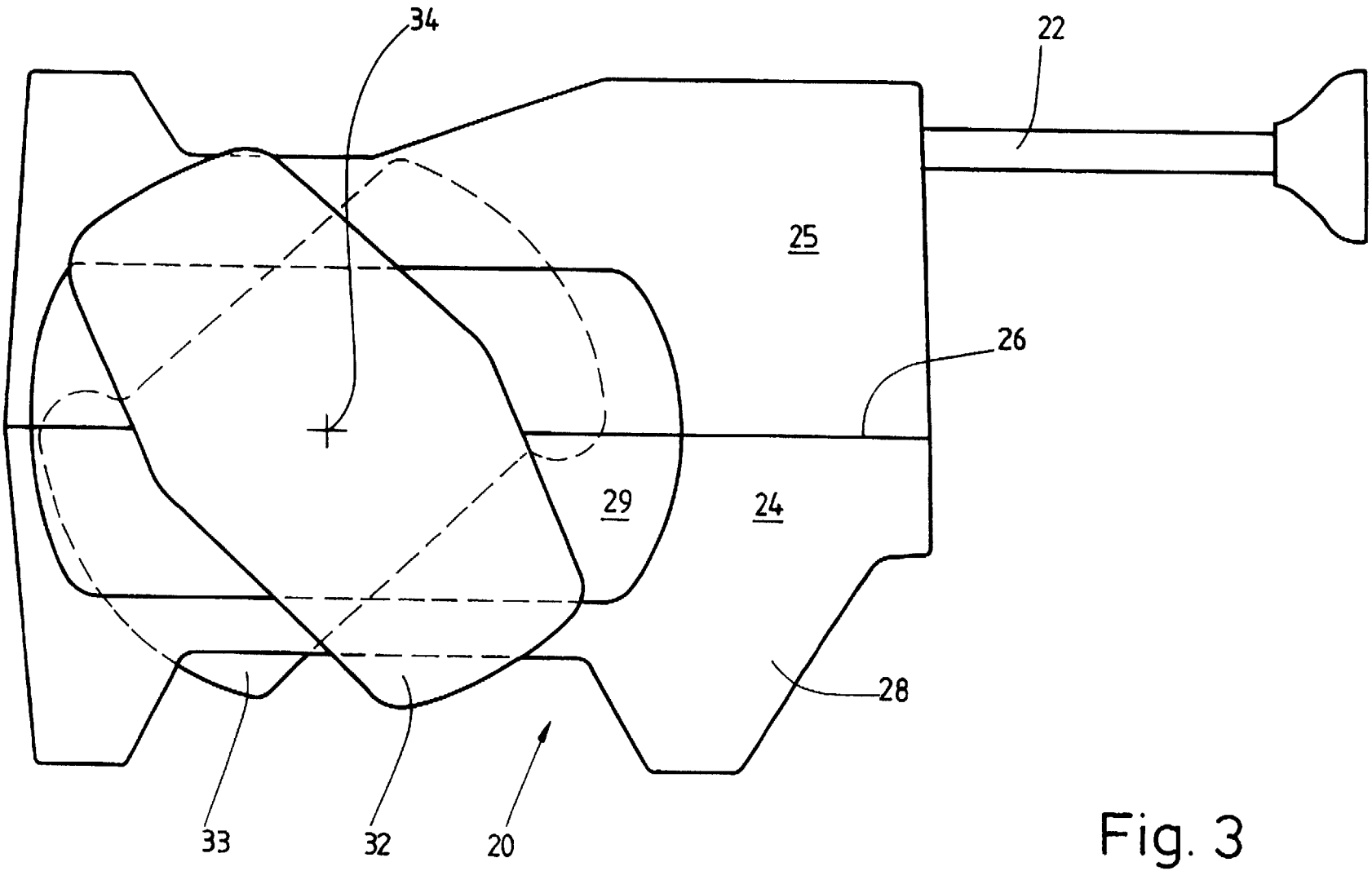
FIG. 3 shows a top view of the locked coupling piece.

The crossbolts 32 and 33 are conically configured. The crossbolts 32 and 33 thereby taper more or less acutely towards their opposite free ends. In the illustrative embodiment shown, the lower crossbolt 33 intended for insertion into a lower container is provided with a conical course which is significantly more pronounced in comparison with the upper crossbolt 32. The crossbolt 33 is provided with diagonally opposing lateral bevels 35, which are configured such that, when the lower crossbolt 33 is inserted into the corner fitting of the corresponding container, the entire locking bolt 21 is twisted from the lower crossbolt 33, to be precise, in top view of the upper crossbolt 32, anti-clockwise into the position shown in FIG. 3. Furthermore, the lower crossbolt 33 has two likewise diagonally opposing bevels 36, which emanate from its bottom side 37 pointing towards the middle piece 30. These bevels 36 serve, as the coupling piece is pulled out of the corner fitting of the lower container, to twist the locking bolt 21 likewise anti-clockwise (once again related to the top view of the crossbolt 32). Similarly, bevels 35 and/or 36 can be disposed on the crossbolt 32.

In the coupling piece of FIGS. 1 to 8, the actuating means 22 is configured in the style of a rope. The rope of the actuating means 22 is guided for this purpose through a corresponding bore 38 in the counter-bearing 28 of the housing 20. One end 39 of the actuating means 22 is fastened by a tongue 40, which is connected, protruding radially outwards, to the middle part 31 of the locking bolt 21. An opposite end 41 of the rope-like actuating means 22 juts out of the counter-bearing 28 of the housing 20 and is provided with a handle 42. Pulling on the handle 42 of the actuating means 22 enables the locking bolt 21 to be twisted manually in the clockwise direction (related to a top view of the upper crossbolt 32).

Figure 8:
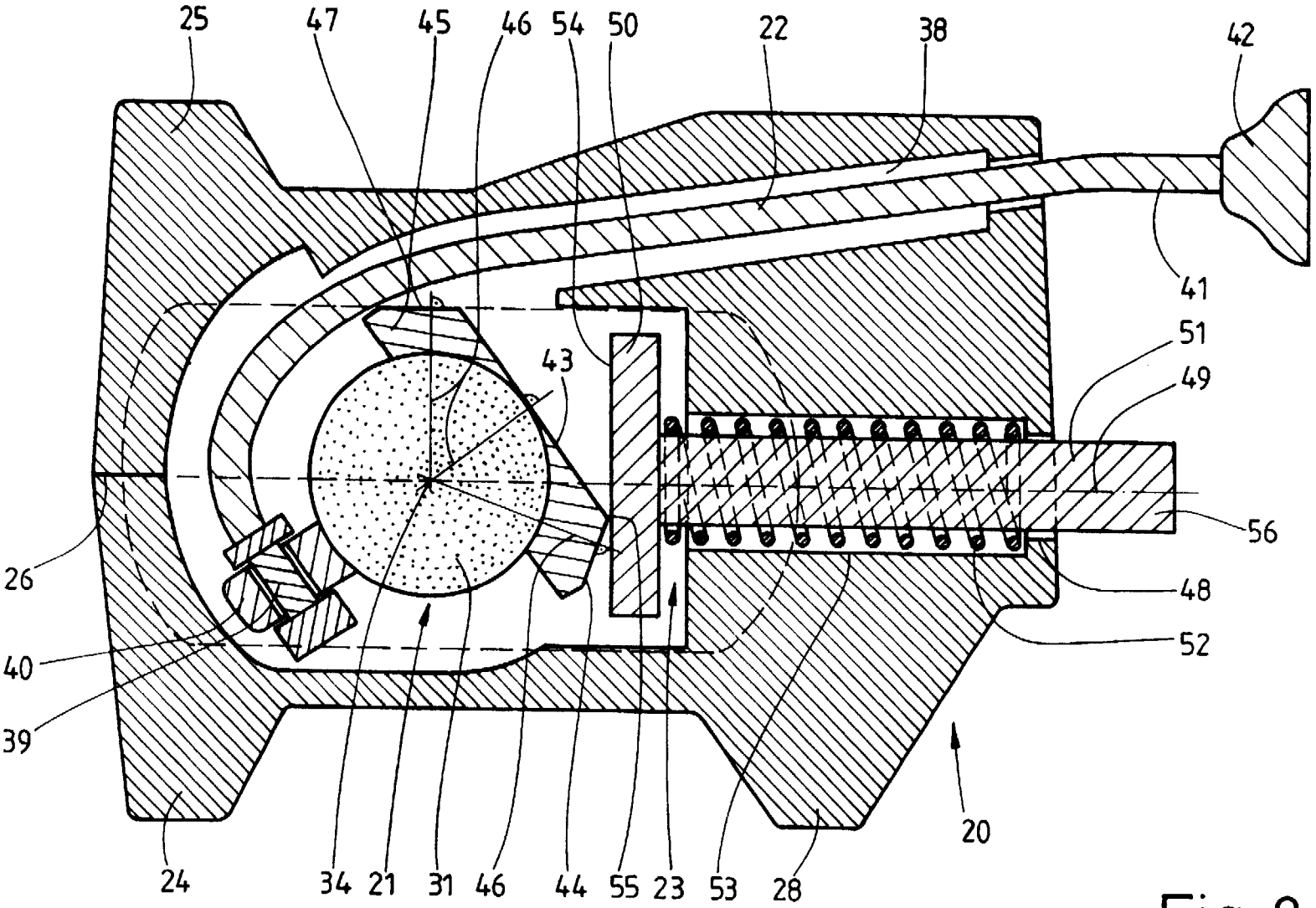
FIG. 8 shows the coupling piece of FIG. 7 in a section analogous to FIG. 4.

According to the invention, the middle piece 30 of the locking bolt 21 is provided with a plurality of stop means. In the illustrative embodiment shown, three stop means are present, which are respectively configured as flat stop faces 43, 44 and 45. A larger, central stop face 43 is limited on opposite sides by smaller stop faces 44 and 45, which are offset relative to the stop face 43, to be precise in the illustrative embodiment shown by 50° respectively. Related to the longitudinal centre axis 34 of the locking bolt 21, the stop faces 43, 44 and 45 are disposed such that a surface perpendicular 46 of each stop face 43, 44 and 45, which perpendicular is indicated in FIG. 8, intersects the longitudinal centre axis 34 at a right-angle. According to a further fundamental feature of the invention, the distance of the stop faces 44 and 45 from the longitudinal centre axis 34 of the locking bolt 21 is greater than the distance of the stop face 43 from the longitudinal centre axis 34. Furthermore, the distances of the stop faces 44 and 45 from the longitudinal centre axis 34 are approximately equal in size. The surface perpendiculars 46 shown in FIG. 8 illustrate this.

The stop faces 43, 44 and 45 are disposed on a crosspiece 47 connected to the middle part 31 of the locking bolt 21. The said crosspiece serves the automatic fixing and twisting of the locking bolt 21. The stop face 44 can, where appropriate, be omitted, since it is not required in normal operation of the coupling piece of FIGS. 1 to 8.

The spring-loaded ram 23 is mounted in a further through-bore 48 in the counter-bearing 28 of the housing 20. A longitudinal centre axis 49 of the through-bore 48 intersects at a right angle the longitudinal centre axis 34 of the locking bolt 21. The spring-loaded ram 23 is composed of a ram plate 50 and a guide rod 51. The two are fixedly joined together. The guide rod 51 is mounted in longitudinally displaceable arrangement in the through-bore 48 of the housing 20, so that the guide rod 51 and the ram plate 50 are displaceable transversely to the locking bolt 21. The guide rod 51 is assigned a spring. In the illustrative embodiment shown, the spring in question is a pressure spring 52 mounted on the outside of the guide rod 51. The pressure spring 52 is located in a widening 53 of the through-bore 48, which widening emanates from the inside of the housing 20. The widening 53 ends shortly before the end of the through-bore 48 to form a stop face for one end of the pressure spring 52. The other end of the pressure spring 52 is supported against the rear side of the ram plate 50. Because of this assignment of the pressure spring 52 to the guide rod 51, the ram 23 is spring-loaded in the direction of the locking bolt 21.

The front side of the ram plate 50 is of planar configuration. The front side of the ram plate 50 thereby forms a stop face 54 on the ram 23. When the stop face 54 is in convergence with the stop face 43 (FIG. 4), the stop face 44 or the stop face 45 (FIG. 6), i.e. the respective stop face 43, 44 or 45 is supported full-face against the stop face 54 of the spring-loaded ram 23, the locking bolt 21 is fixed in the respective relative position to the housing 20. This fixing is realized by virtue of the fact that the surface perpendiculars 46 of the stop faces 43, 44 and 45 on the locking bolt 21 and the stop face 54 on the spring-loaded ram 23 are situated one behind the other on a common line and this (imaginary) line perpendicularly intersects the longitudinal centre axis 34 of the locking bolt 21. Due to different distances of the stop faces 43, 44 and 45 from the longitudinal centre axis 34 of the locking bolt 21, the ram 23, in bearing contact against the stop faces 44 and 45, is relatively strongly pretensioned by the pressure spring 52, whereas, in bearing contact against the stop face 43, the ram 23 is only slightly spring-pretensioned. A yet greater spring-pretensioning is acquired by the ram 23 when, outside a fixing setting of the locking bolt 21, it bears against an edge between adjacent stop faces on the locking bolt 21, for example against the edge 55, shown in FIG. 8, between the stop faces 43 and 44. This spring-pretensioning of the ram 23 results in the ram 23 automatically twisting the locking bolt 21 clockwise to the point where the stop face 43 is aligned parallel to the stop face 54 on the ram 23 and the ram 43, by virtue of its spring force, presses with the stop face 44 against the stop face 43 so as to fix the locking bolt 21.

Figure 4:
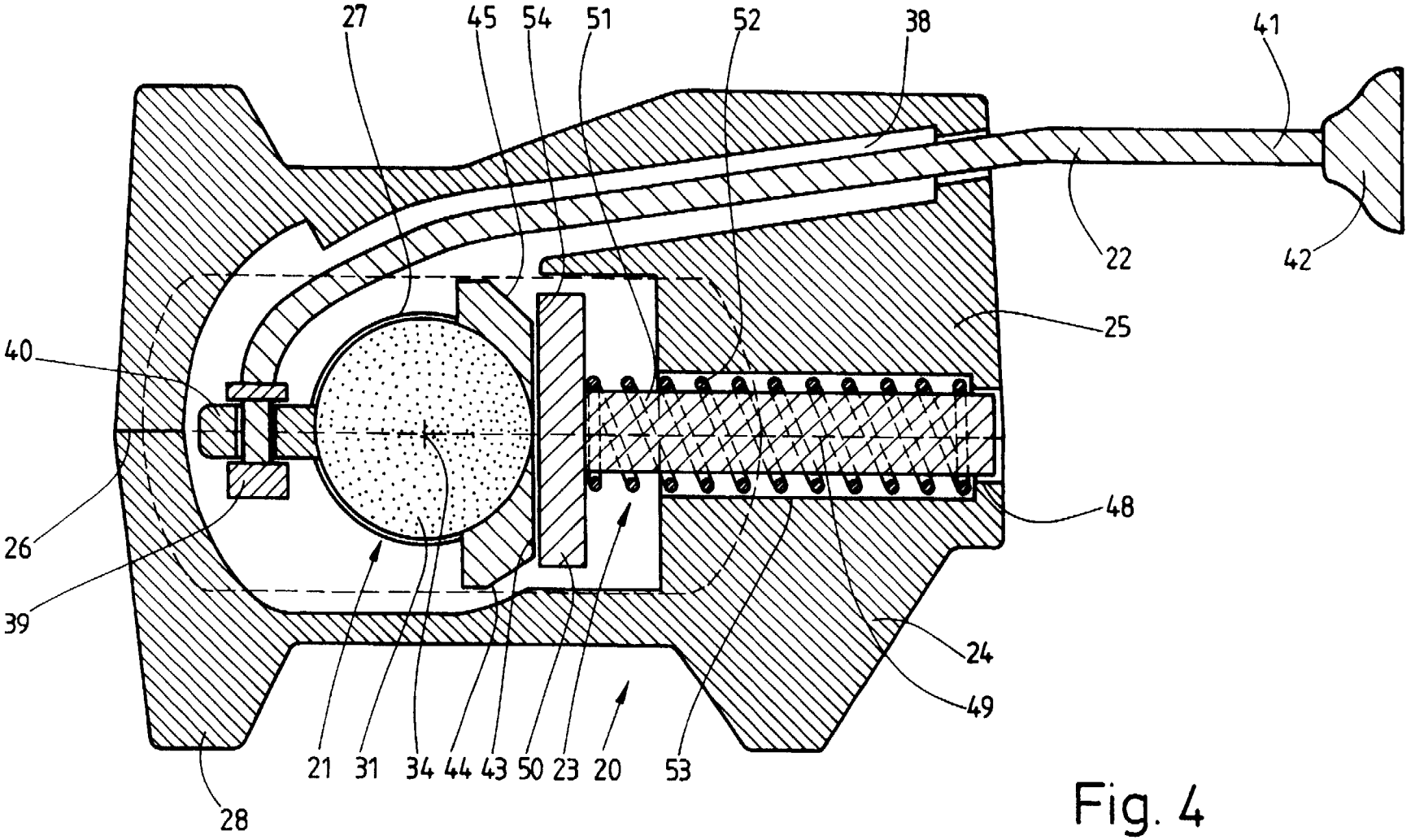
FIG. 4 shows a section IV—IV through the locked coupling piece according to FIG. 3.
Figure 5:
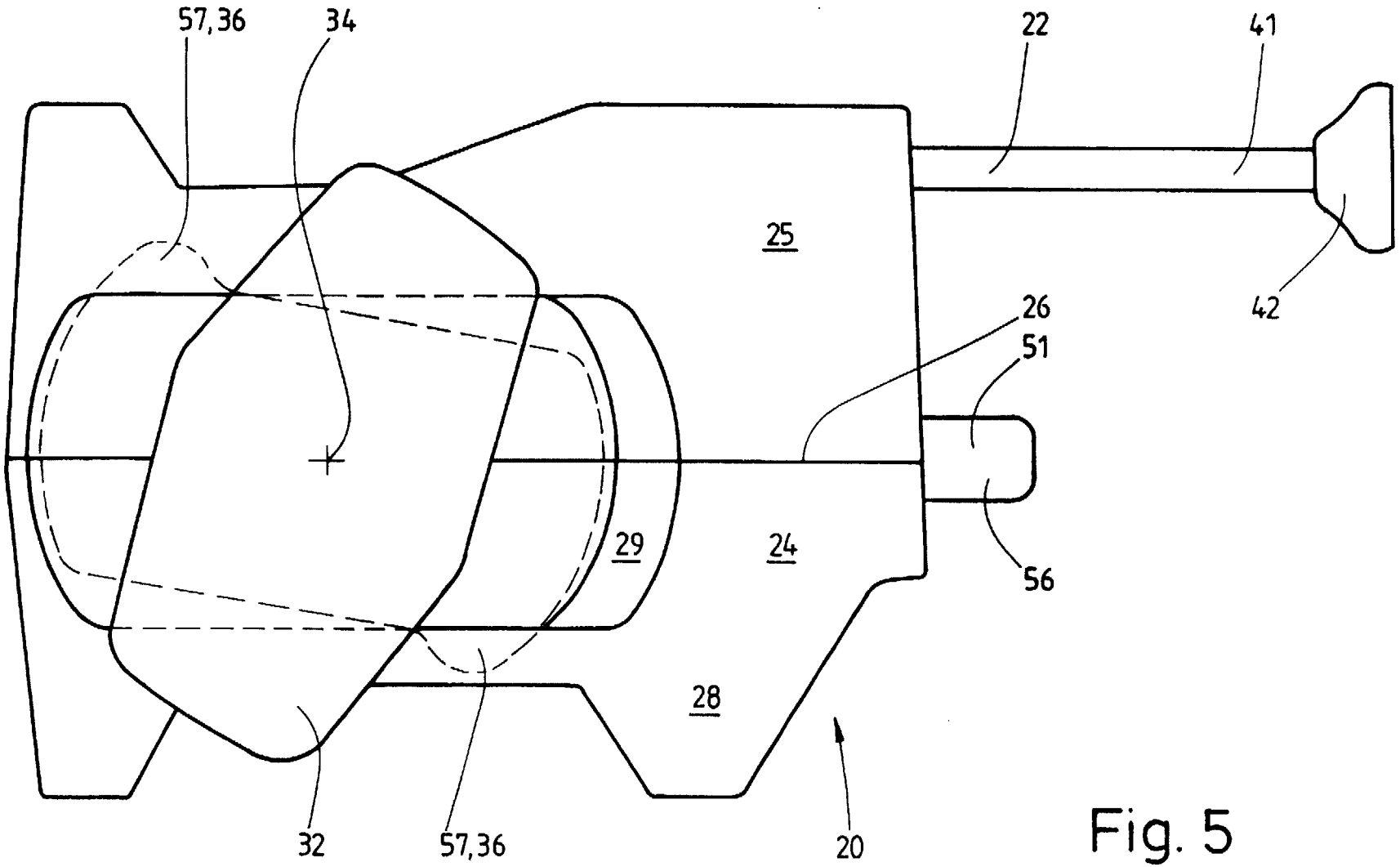
FIG. 5 shows the coupling piece with an unlocked lower crossbolt in a top view analogous to FIG. 3.
Figure 6:
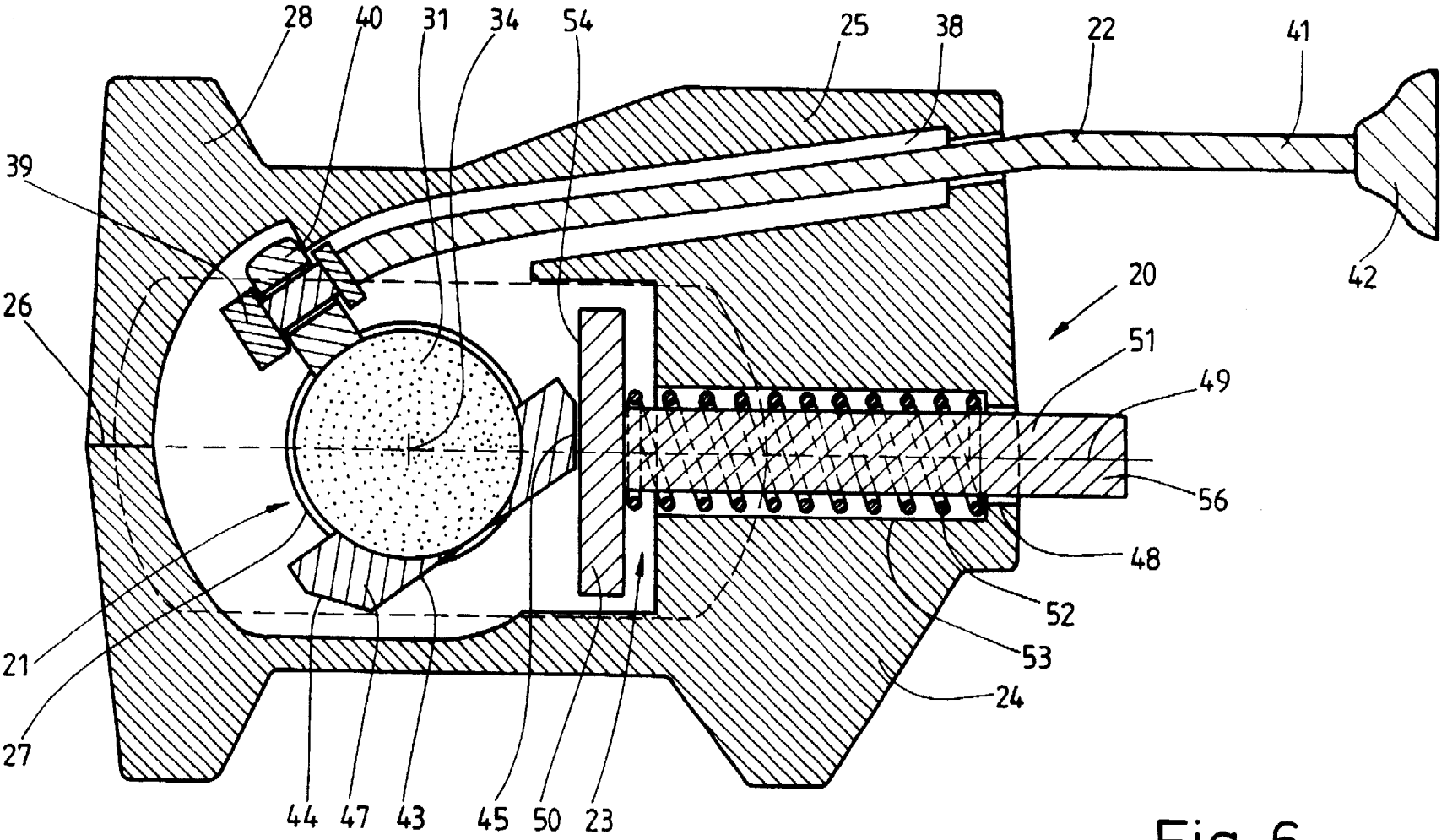
FIG. 6 shows a section through the coupling piece of FIG. 5 analogous to FIG. 4.
Figure 7:
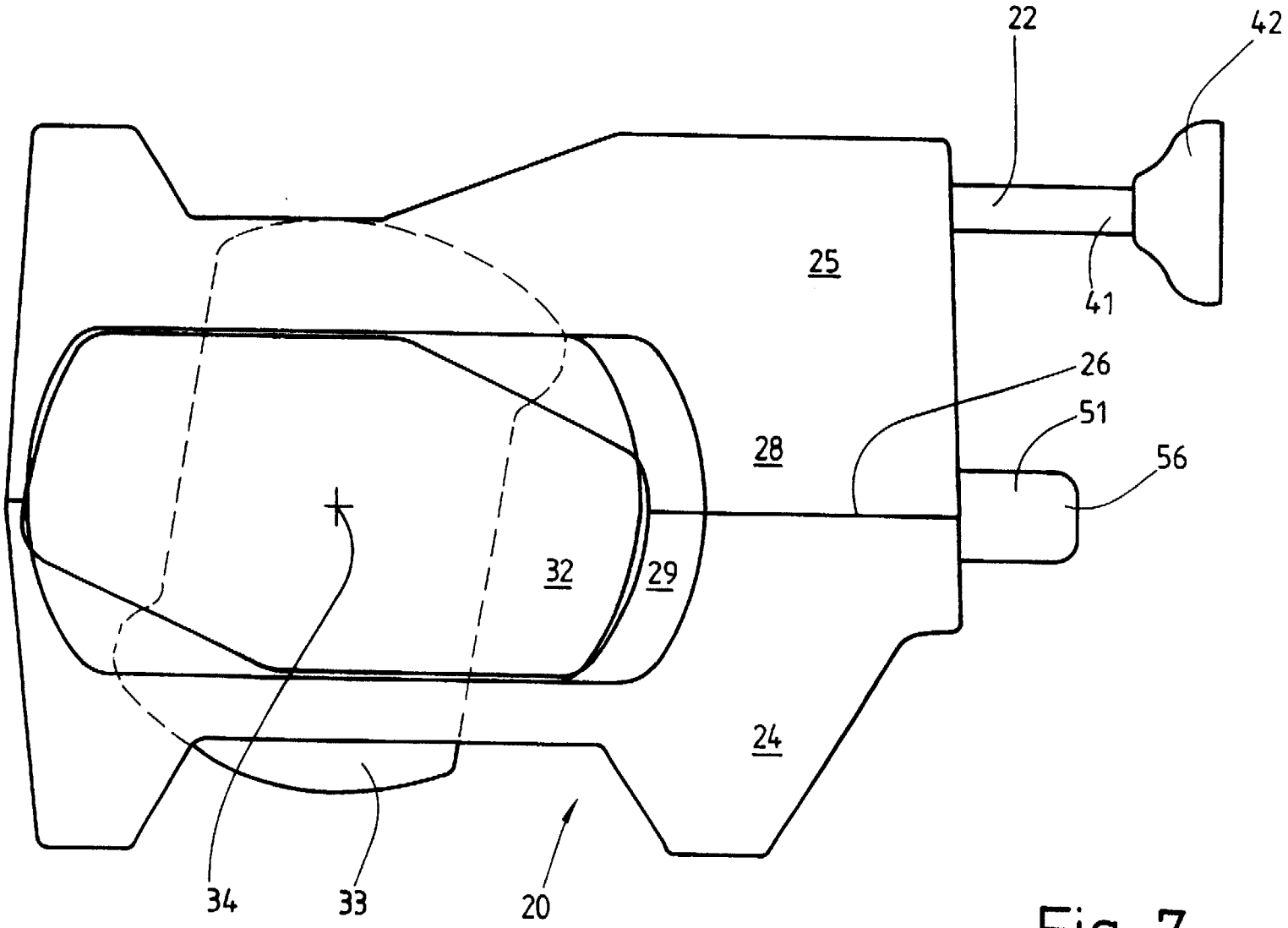
FIG. 7 shows a top view of the coupling piece with unlocked upper crossbolt.

The guide rod 51 of the ram 23 is provided with a particular length. This length is chosen such that it is located, when the stop face 54 of the ram 23 is in bearing contact against the stop face 43 of the locking bolt 21, fully within the counter-bearing 28 of the housing 20, the free end face of the guide rod 51 preferably terminating approximately flush with the corresponding edge of the counter-bearing 28 (FIG. 4). When the stop face 54 is in bearing contact against the stop faces 44 and 45, on the other hand, an end region 56 of the guide rod 51 is visibly outside the housing 20 (FIG. 6).

The working method of the coupling piece represented in FIGS. 1 to 8 is as follows:

First of all, the coupling piece is pre-locked beneath the lower corner fitting of an upper container. To this end, the locking bolt 21 is manually twisted from the lower crossbolt 33 into the position represented in FIG. 7, in which the upper crossbolt 32 is in convergence with the middle piece 29. In this position of the locking bolt 21, the upper crossbolt 32 can be inserted into the lower corner fitting of the upper container. The lower crossbolt 33 is then released and, by a pulling on the rope-like actuating means 22 (viewed from above onto the crossbolt 32), is twisted clockwise into the position represented in FIG. 5. After this, the coupling piece is pre-locked beneath the lower corner fitting of the upper container. The stop face 45 of the locking bolt herein bears against the stop face 54 of the spring-loaded ram 23 (FIG. 6). The locking bolt 21 is thereby fixed in its pre-locked position. The end region 56 of the guide rod 51 of the ram 23 juts out of the counter-bearing 28 of the housing 20 to indicate that the coupling piece is (only) pre-locked.

The upper container is now mounted with the coupling piece, which is pre-locked beneath its lower corner fitting, onto the lower container to be connected to the upper container. Diagonally opposing projections 57 on the lower crossbolt 33, which are not aligned with the lower middle piece 29 (FIG. 5), come to bear against the upper corner fitting of the lower container. Due to the helical bevel 35 of the conical lower crossbolt 33, as the upper container is lowered further onto the lower container, the locking bolt 21 (related to the top view of the upper crossbolt 32) is twisted anti-clockwise. The stop face 45 on the locking bolt 21 is herein removed from contact with the stop face 54 on the spring-loaded ram 23 and the ram is provided with a maximum spring-pretensioning. Once the upper container is set down onto the lower container, i.e. the lower crossbolt 33 is slipped through the long hole of the upper corner fitting of the lower container, the locking bolt 21 can be freely twisted. It is now twisted by the ram 23 further anti-clockwise until the stop face 43 on the locking bolt 21 bears fully against the stop face 54 on the ram (FIG. 4). In this position of the locking bolt 21, both crossbolts 32 and 33 are moved out of convergence with the middle pieces 29 and 30 of the housing 20 which are assigned to them, so that the coupling piece has automatically moved into a locking position which joins both containers together. The end region 56 of the guide rod 51 is herein located fully in the housing 20, whereby it is indicated that the coupling piece is properly locked.

For the unlocking of the coupling piece, by a pulling on the rope-like actuating means 22, the locking bolt 21 (related to the top view of the upper crossbolt 32) is twisted clockwise out of the position shown in FIG. 4 into the position shown in FIG. 6, in which the crossbolt 32 is fixed by contact of the stop face 45 of the locking bolt 21 against the stop face 54 of the ram 23. Now only the diagonally opposing projections 57 on the lower crossbolt 33 are still projecting relative to the middle piece 30. Due to the bevels 36, described at the beginning, on the bottom side 37 of the crossbolt 33, which bottom side points towards the middle piece 30 and is located in the region of the projections 57, as the upper container is raised from the lower container the locking bolt 21 is rotated back anti-clockwise to the point where the lower crossbolt 23 is able to be pulled out through the long hole of the upper corner fitting of the lower container. By virtue of the upper crossbolt 32, the coupling piece herein continues to remain locked to the lower corner fitting of the upper container, so that the coupling piece together with the upper container can be raised. Manual twisting of the locking bolt 21 on the lower crossbolt 33 allows the coupling piece to be removed from the lower corner fitting of the upper container. It is also conceivable, by pulling on the rope-like actuating means 22, to return the coupling piece, following detachment from the lower container, into the pre-locking position shown in FIGS. 5 and 6, after which the upper container, with the coupling piece pre-locked to it, can be placed for restowing purposes onto another container and can be connected thereto.

Figure 9:
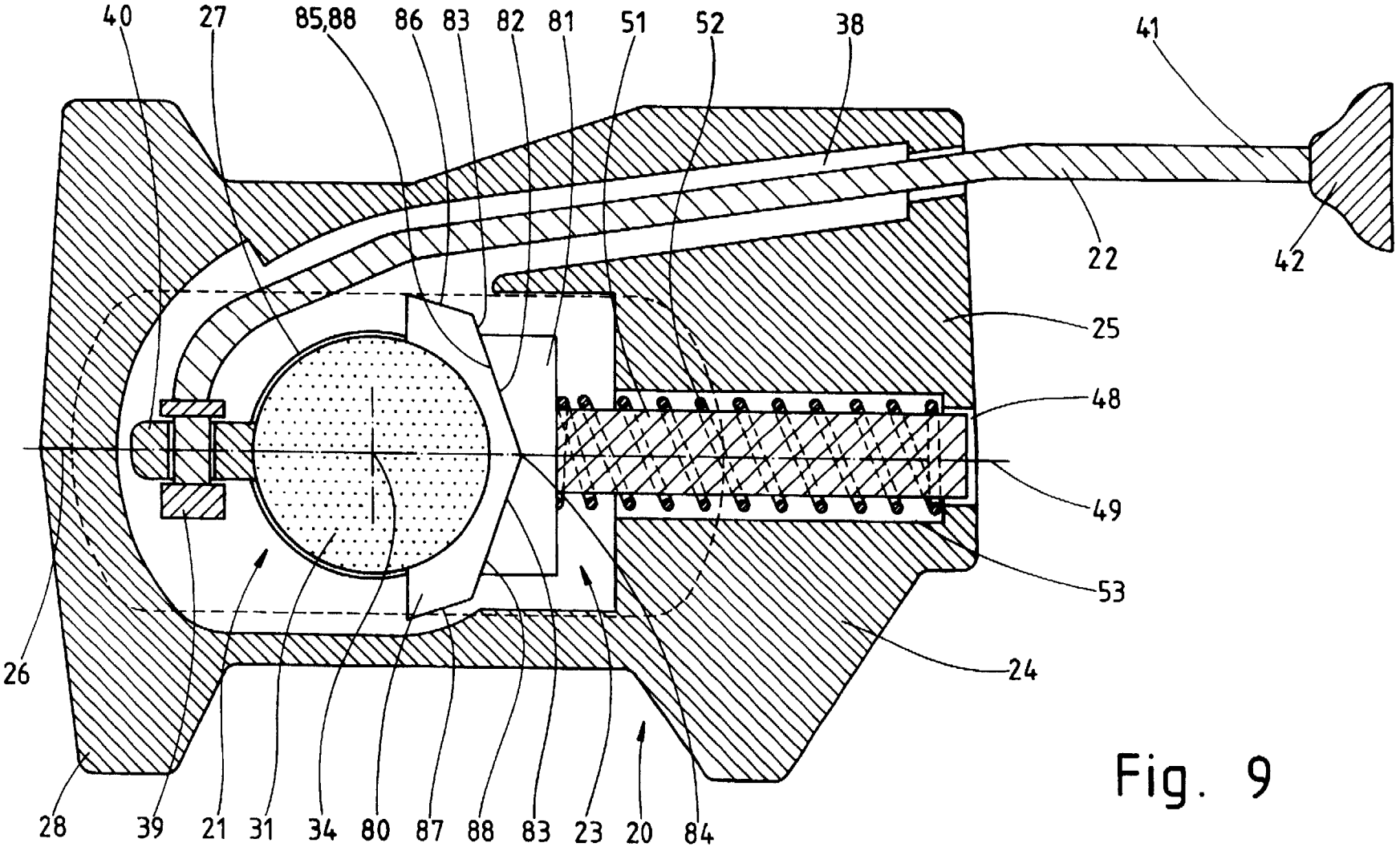
FIG. 9 shows a second illustrative embodiment of a coupling piece in a section and in a position of the locking bolt analogous to FIG. 4.
Figure 10:
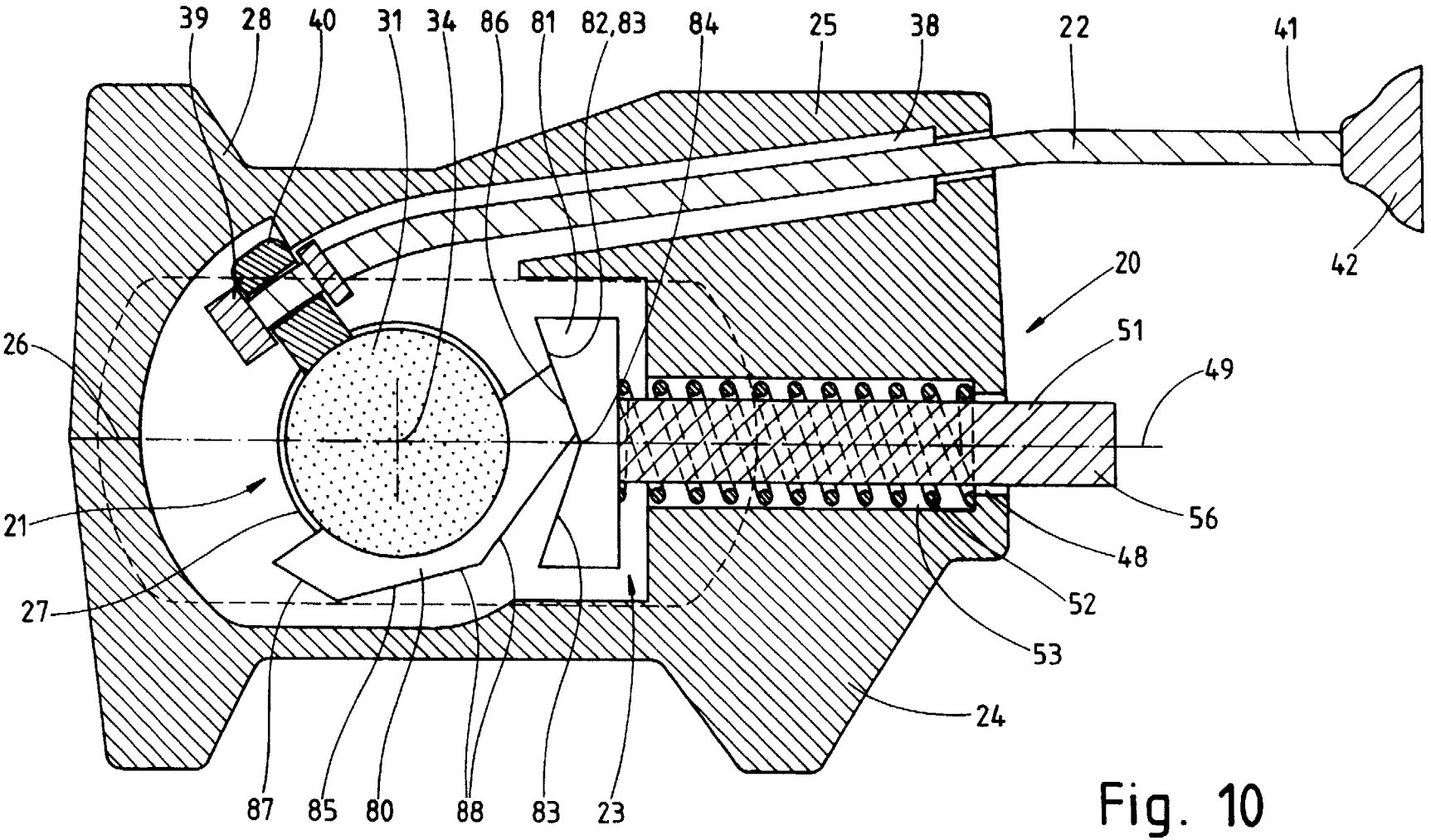
FIG. 10 shows the coupling piece of FIG. 9 in a position of the locking bolt analogous to FIG. 6.

FIGS. 9 and 10 show a second illustrative embodiment of the coupling piece according to the invention. This differs from the coupling piece according to the first illustrative embodiment of FIGS. 1 to 8 by differently configured stop means on the crosspiece 80 of the locking bolt 21 and on the ram plate 81 of the spring-loaded ram 23. Otherwise, the coupling piece of FIGS. 9 and 10 corresponds to that of FIGS. 1 to 8, for which reason identical reference numerals are used for identical parts.

The spring-loaded ram 23 has a ram plate 81, which displays a single stop means having a convex stop face 82. In concrete terms, the stop face 82 is of V-shaped configuration, in that it is composed of two part-faces 83 running at an obtuse angle of greater than 90° to each other. The two part-faces 83 meet on a vertical apex line 84, which lies on a vertical centre plane of the coupling piece, which plane runs through the longitudinal centre axis 34 of the locking bolt 21. The crosspiece 80, which corresponds with the spring-loaded ram 23, is connected non-twistably to the locking bolt 21 and has three stop faces 85, 86 and 87 forming stop means. The central stop face 85, when the coupling piece is definitively locked, bears fully against the stop face 82 of the spring-loaded ram 23 (FIG. 9). To this end, the stop face 85 is configured such that it corresponds to the V-shaped stop face 82 on the ram plate 81. Accordingly, the stop face 85 likewise has two part-faces 88, which run in a V-shape concavely to each other. At opposite sides of the stop face 85 there respectively adjoins one of the stop faces 86 and 87 respectively. When the upper crossbolt 32 is unlocked, the stop face 86 of the crosspiece 80 bears against a part-face 83 of the stop face 82 of the spring-loaded ram 23 (FIG. 10). A fixing of the locking bolt 21 consequently takes place, the upper crossbolt 32 being unlocked. Conversely, the opposite stop face 87 bears against a part-face 83 of the stop face 82 of the spring-loaded ram 23 whenever the lower crossbolt 33 is in an unlocked state.

In its operation, the coupling piece according to the second illustrative embodiment of the invention (FIGS. 9 and 10) corresponds to the coupling piece of the first illustrative embodiment of the invention (FIGS. 1 to 8). Reference is therefore made in full to the content of the working description relating to the coupling piece according to the first illustrative embodiment of the invention.

Figure 11:
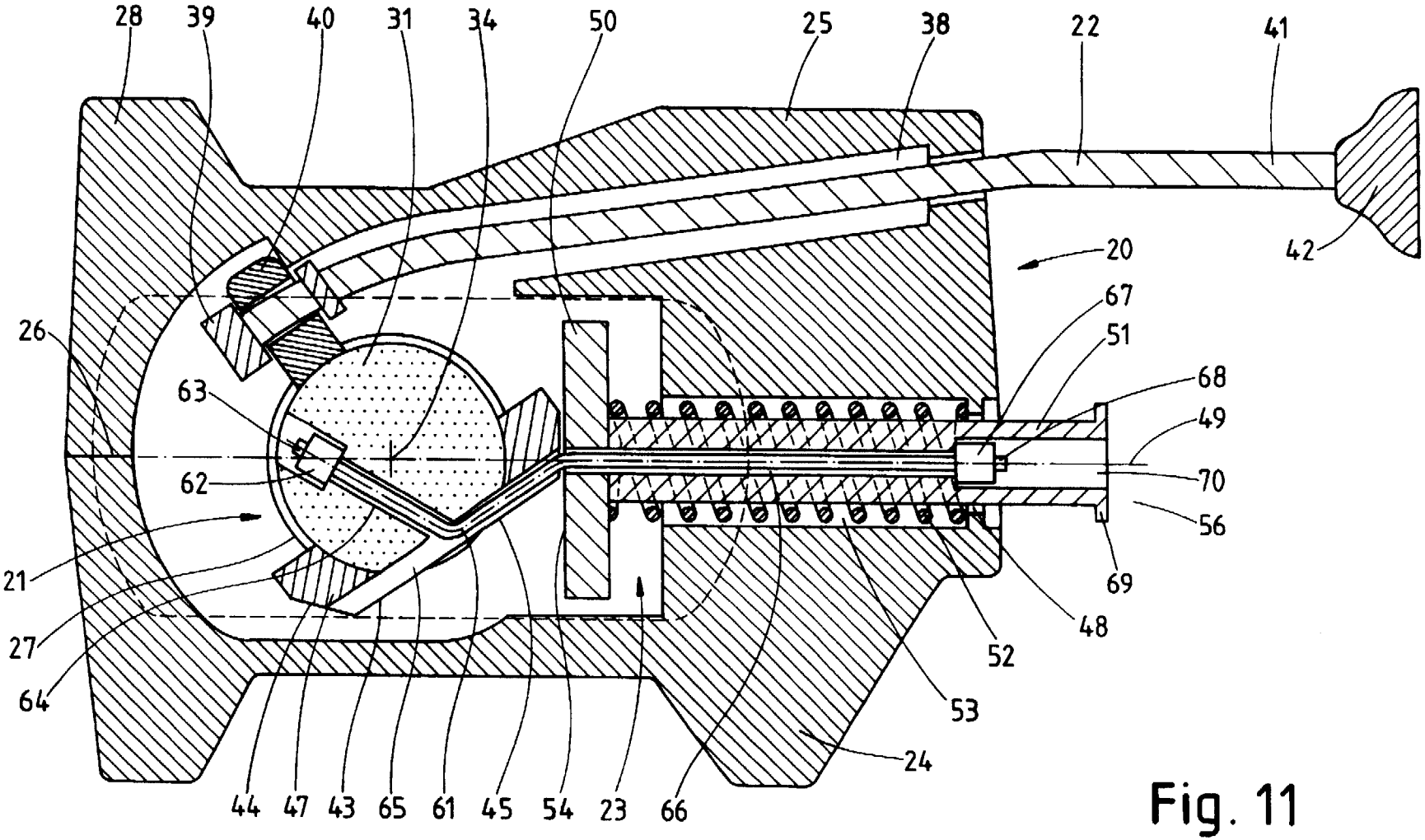
FIG. 11 shows a third illustrative embodiment of a coupling piece in a section and in a position of the locking bolt analogous to FIG. 6.

FIG. 11 shows a different illustrative embodiment of the coupling piece, which essentially corresponds to the coupling piece described above. To this extent, identical reference numerals are used for identical parts.

The peculiarity of the coupling piece shown in FIG. 11 consists in a reset element in the form of a (second) actuating means 61. This actuating means 61, which (like the actuating means 22) is of rope-like configuration, is anchored by one end in the middle part Ad 31 of the locking bolt 21 by a thickening 62 at the end 63 of the actuating means 61. Through a transverse bore 24 in the middle part 31, the actuating means 61 is guided centrally out of the stop face 43. The actuating means runs onward through a groove 65, emanating from the stop face 43, in the crosspiece 47. The groove 65 is dimensioned such that, in the region of the crosspiece 47 of the actuating means 61, it lies hidden behind the stop face 43. The actuating means 61 is guided onward through the middle of the spring-loaded ram 23, to which end a central bore 66 runs through the ram plate 50 and the guide rod 51. Starting from the free end of the guide rod, the bore 66 is provided with a widening for receiving a thickening 67 at the corresponding end 68 of the actuating means 61.

In that setting of the locking bolt which is shown in FIG. 11, the coupling piece is in an unlocked or pre-locked position. In this, the actuating means runs in a zigzag from the locking bolt 21 to the spring-loaded ram 23. The two are connected by the actuating means 61. By withdrawing the end of the guide rod 51 from the housing 20 of the coupling piece, the spring-loaded ram 23 is moved, counter to the pretensioning of the pressure spring 52, away from the locking bolt 21, and the actuating means 61 is thereby tightened. Due to this tightening, the locking bolt 21 is twisted anti-clockwise, so that the stop face 43 can make its way into bearing contact against the stop face 54 on the spring-loaded ram 23. The locking of the coupling piece is thereby restored. It is thereby possible to relock a coupling piece which has been inadvertently unlocked between the containers stacked one above the other.

To enable the end of the guide rod 51, when coupling pieces are situated between the containers, to be able to be pulled out of the housing 20, counter to the pretensioning of the pressure spring 52, by an appropriate rod-shaped auxiliary tool, the free end of the guide rod 21 has a collar 69. Against the collar 69 there can be supported a fork-shaped end of the auxiliary tool. The housing 20 has a recess 70 which corresponds with the collar 69 and in which the guide rod 51 with the collar 69 is accommodated whenever the stop face 43 is bearing against the stop face 54, i.e. the coupling piece is locked.

Figure 12:
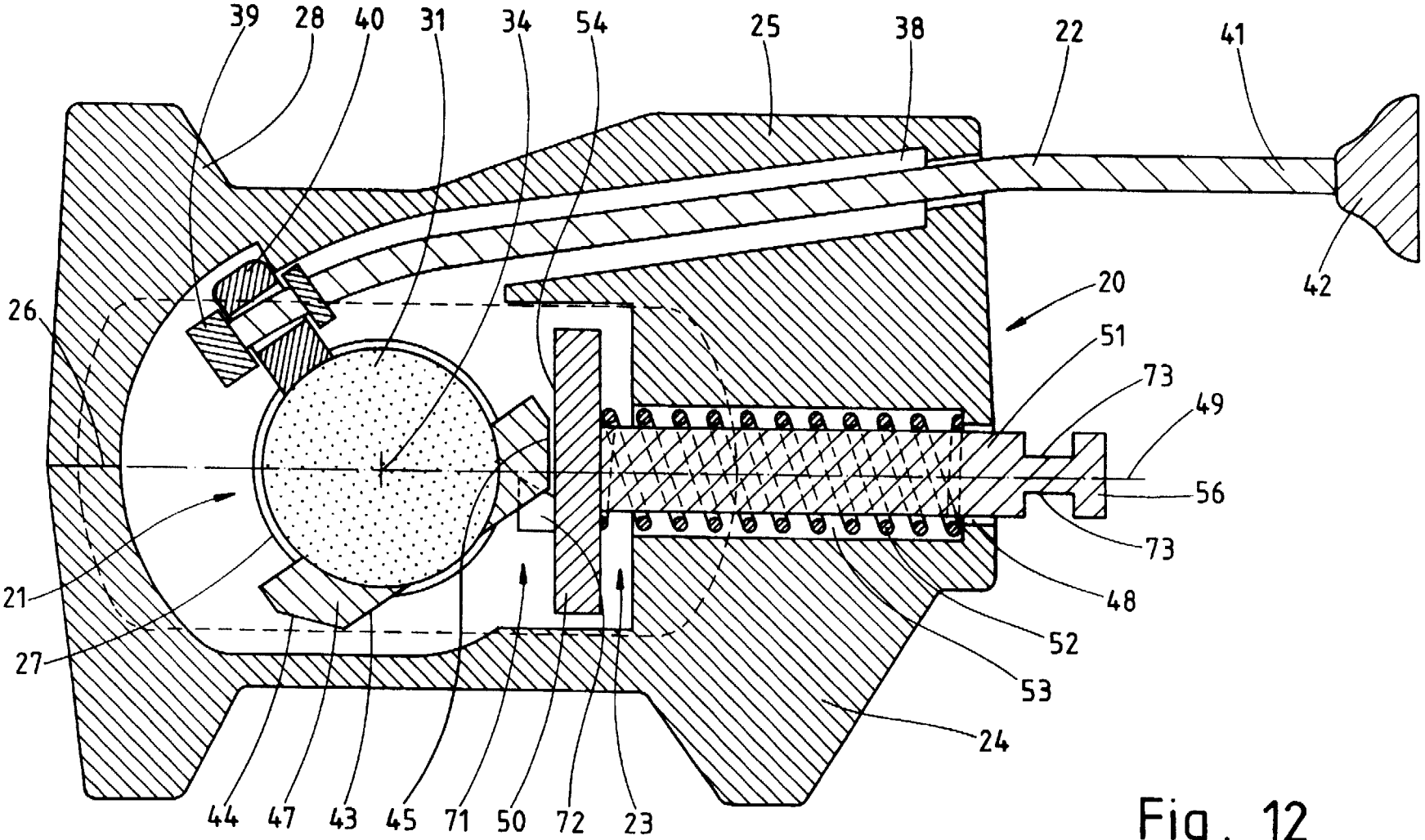
FIG. 12 shows a fourth illustrative embodiment of a coupling piece in a section and in a position of the locking bolt analogous to FIG. 6.

FIG. 12 shows a further illustrative embodiment of the invention. This coupling piece essentially again corresponds to the coupling piece of FIGS. 1 to 8, for which reason identical reference numerals are once again used for identical parts.

The coupling piece of FIG. 12, too, has a second actuating means 71. This is formed by a projection 72 on the stop face 54 of the spring-loaded ram 23. This projection 72 lies beneath the crosspiece 47 on the locking bolt 21. By twisting the spring-loaded ram 23, the projection 72 on the stop face 54 of the ram plate 50 is forced from below against the crosspiece 47. The locking bolt 21 is thereupon twisted anti-clockwise, so that the crossbolts 32 and 33 of the locking bolt 21 make their way out of their unlocked or pre-locked position into their locking position, in which the stop face 43 bears against the stop face 54 of the ram plate 50 after the spring-loaded ram 23 has previously been rotated back again to the point where the projection 72 on the ram plate 50 is again located beneath the crosspiece 47. The return rotation of the spring-loaded ram 23 can be effected by the pressure spring 52, the ends of which, for this purpose, are connected, on the one hand, non-twistably to the guide rod 51 and, on the other hand, non-twistably to the housing 20.

In order to facilitate the twisting of the spring-loaded ram 23, the free end of the guide rod 51 is provided with opposing constrictions 73. These form key faces, which enable a detachable, non-twistable connection of a fork-shaped end of an auxiliary tool to the guide rod 51.

Figure 13:
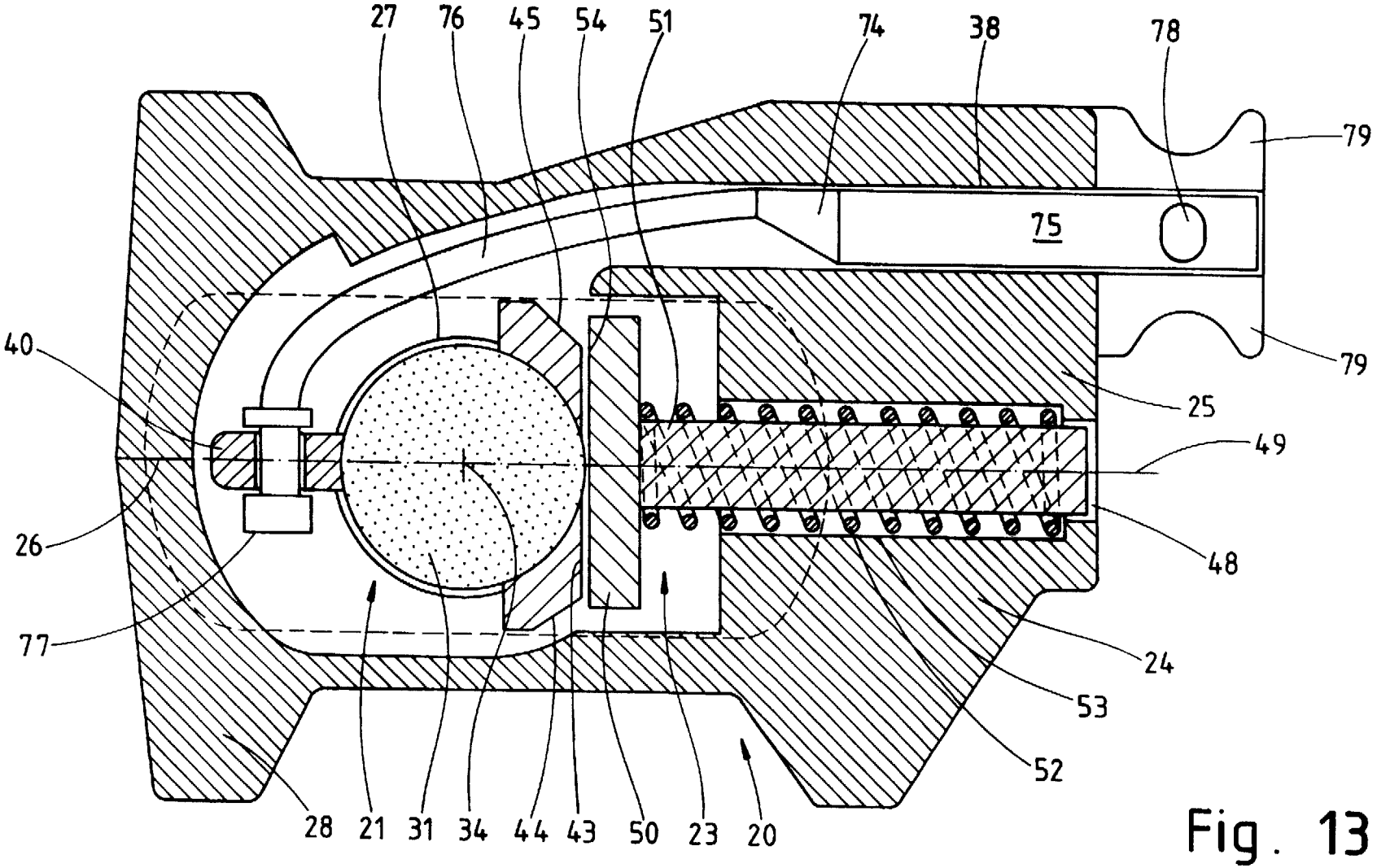
FIG. 13 shows a fifth illustrative embodiment of a coupling piece in a section and in a position of the locking bolt analogous to FIG. 4.

FIG. 13 shows a coupling piece, which essentially again corresponds to the coupling piece of FIGS. 1 to 8 and, to this extent, is provided with identical reference numerals. This coupling piece displays a single actuating means 74, which is configured for the transmission of both tensile and compression forces. The locking bolt 21 is thereby able to be twisted by the actuating means 74 in opposite directions.

The actuating means 74 is composed of a rigid handle part 75 and a flexible connecting part 76. A free end 77 of the connecting part 76 is connected to the tongue 40 on the locking bolt 21. The connecting part 76 is configured such that it is flexible in relation to the direction of its longitudinal extent, yet is able to transmit both tensile and compression forces. The handle part 75 is provided in its end region with a long hole 78. The length of the handle part 75 is dimensioned such that it juts with the long hole 78, both in the locked and in the pre-locked setting of the coupling piece, out of the housing 20. This part of the handle part 75 which juts out of the housing 20 is assigned two tongues 79 connected fixedly to the housing. The tongues 79 are located on opposite sides of that end of the handle part 75 which juts out of the housing 20. The tongues 79 serve to support an auxiliary tool which engages in the long hole 78 of the handle part 75.

Figure 14:
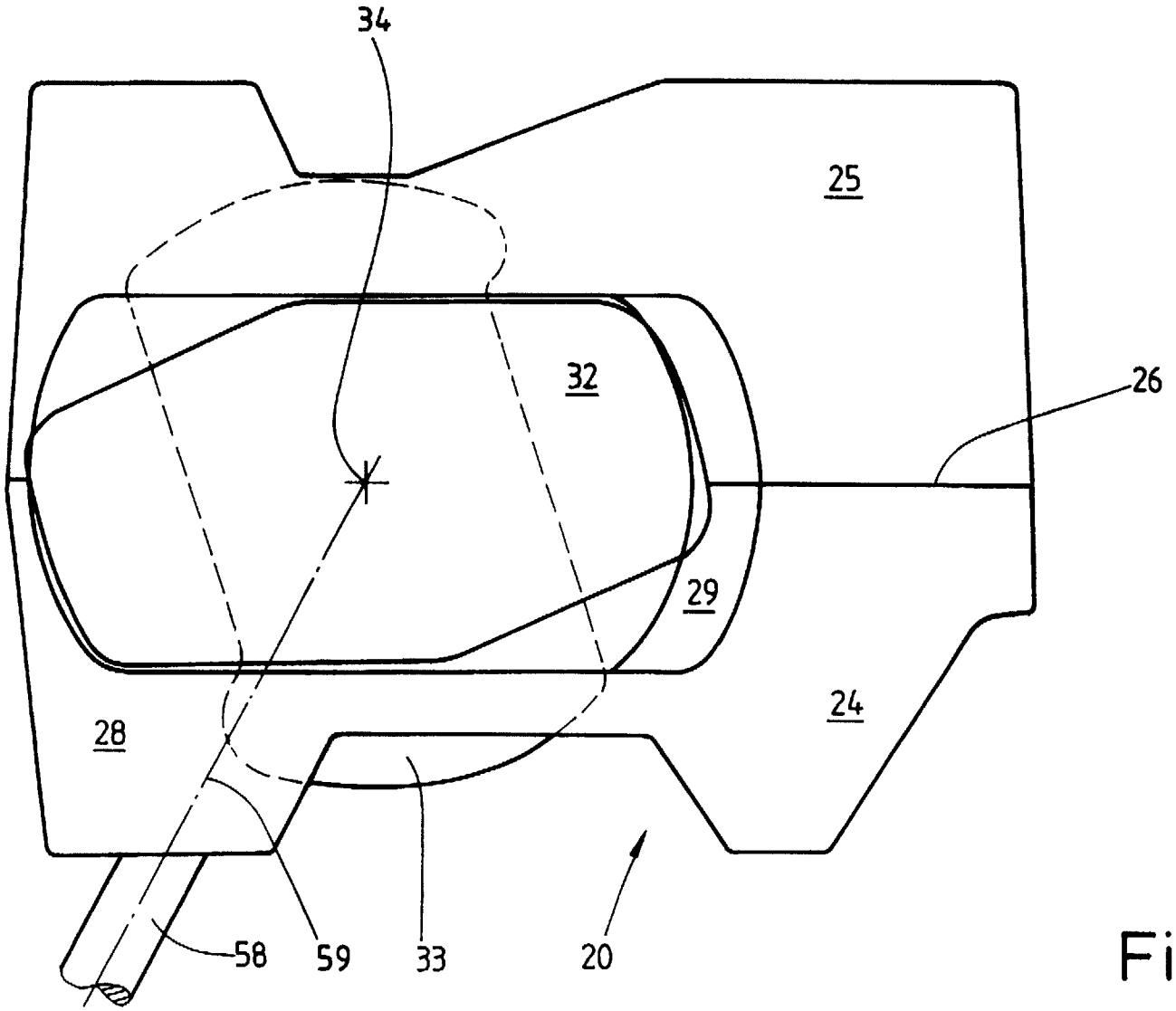
FIG. 14 shows a sixth illustrative embodiment of a coupling piece with unlocked upper crossbolt in a top view.
Figure 15:
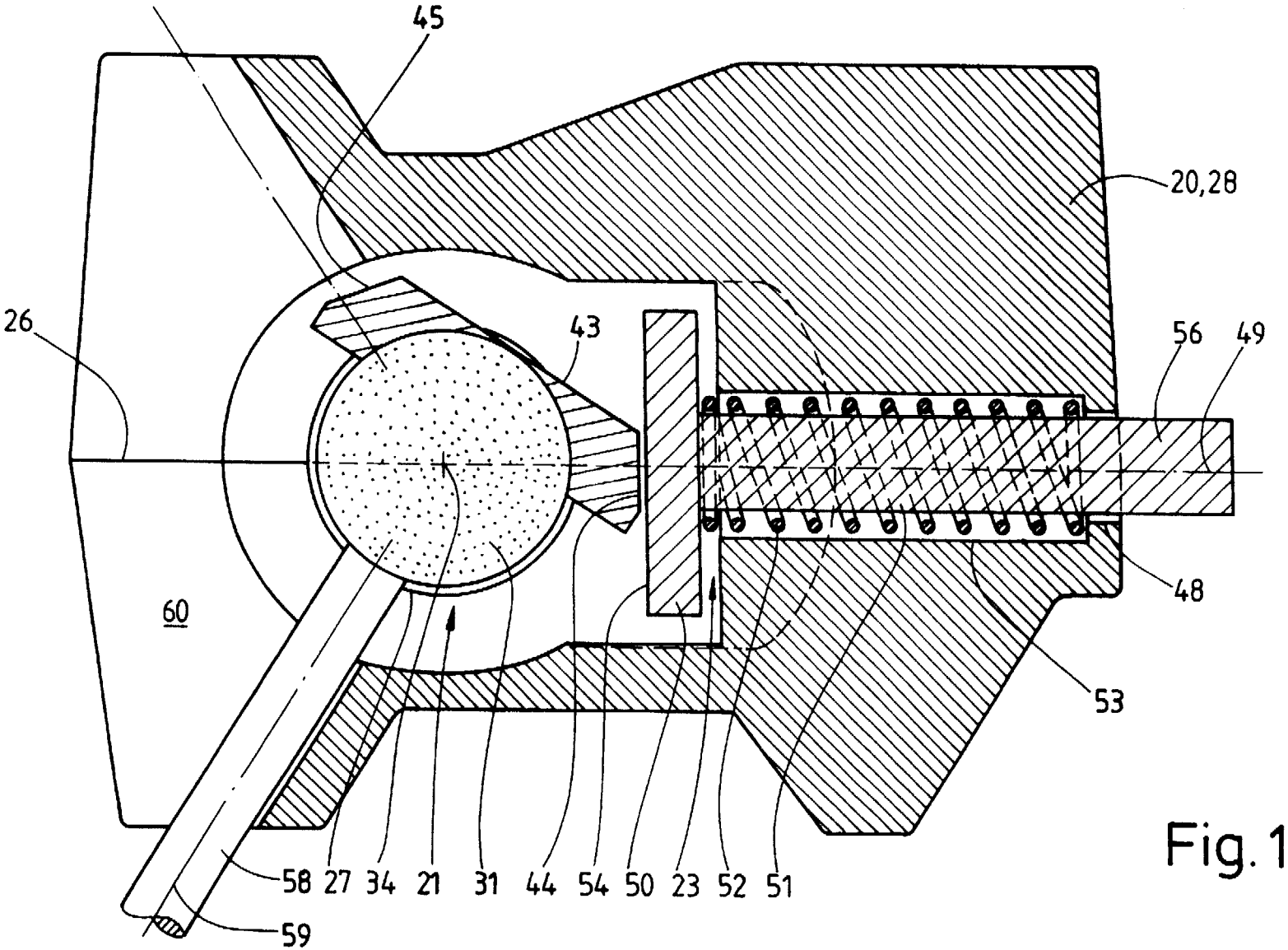
FIG. 15 shows the coupling piece of FIG. 14 in a section analogous to FIG. 4.

The coupling part which is shown in FIGS. 14 and 15 differs from the coupling piece of the illustrative embodiments of FIGS. 1 to 9 again with respect to the configuration of the actuating means. Insofar as identical parts are present, identical reference numerals are used and reference is made, to this extent, to the description relating to the coupling piece of FIGS. 1 to 8.

In the coupling piece of FIGS. 14 and 15, the actuating means is configured as an actuating lever 58. The actuating lever 58 is connected to the middle part 31 of the locking bolt 21, to be precise such that the so longitudinal centre axis 59 of the actuating lever 58 intersects the longitudinal centre axis 34 of the locking bolt 21 at right angles. Pivoting of the actuating lever 58 in a longitudinal centre plane, running perpendicularly to the longitudinal centre axis 34 of the locking bolt 21, of the counter-bearing 28, enables the locking bolt 21 to be twisted. For this purpose, there is disposed in the counter-bearing 28 a central, laterally open clearance 60 in the form of a long hole which widens outwards in a funnel shape. The clearance 60 is dimensioned such that the locking bolt 21 can be brought by the actuating lever 58 into three different positions, in which either the stop face 43, the stop face 44 or the stop face 45 runs parallel to the stop face 54. At the same time, the clearance 60 forms opposing stops for limiting the maximum angle of rotation of the locking bolt 21, as a result of which this cannot be pivoted beyond the contact of the stop faces 44 and 45 respectively against the stop face 54.

The working method of the coupling piece of FIGS. 14 and 15 basically corresponds to that of the coupling piece of FIGS. 1 to 8. To this extent, reference is made to the working method described in connection with the latter coupling piece.

In addition, the coupling piece of FIGS. 14 and 15 allows a further function, namely a so-called "dual function". This is made possible by the rigid actuating lever 58, which, for the unlocking of the coupling piece, starting from the position shown in FIG. 4, of the locking bolt 21, is able to twist the locking bolt 21 (related to the top view of the upper crossbolt 32) anti-clockwise into the position shown in FIGS. 14 and 15, in which the crossbolts 32 and 33 are in the position shown in FIG. 14. The upper crossbolt 32 is thereupon brought into convergence with the middle piece 29 of the housing 20. Consequently, the upper container can be raised from the lower container, the coupling piece remaining locked in place on the lower container.

If, for example, the actuating lever 58 of the locking bolt 21, starting from the position shown in FIG. 4, were to be twisted clockwise into the position shown in FIG. 6, the coupling piece would be able to be detached from the lower container and raised with the upper container from the lower container, to be precise in the manner described at the beginning in connection with the first illustrative embodiment of the coupling piece of FIGS. 1 to 8.

What is claimed is:

1. A coupling piece for the detachable connection of containers, especially of containers stacked one above the other on board ships, having a housing and a locking bolt mounted by a middle part rotatably in the housing, which locking bolt has at opposite ends of the middle part, crossbolts, characterized in that:

the locking bolt (21) is assigned a pressure element:

the locking bolt (21) and the pressure element have corresponding first and second stop means, respectively, for fixing the locking bolt (21); and the pressure element of the locking bolt (21) can be twisted in such a way that the first stop means on the middle part (31) of the locking bolt (21) can be brought into engagement with the second stop means on the pressure element, which engagement fixes the locking bolt (21).

2. A coupling piece for the detachable connection of containers, especially of containers stacked one above the other on board ships, having a housing and a locking bolt mounted by a middle part rotatable in the housing, which locking bolt has, at opposite ends of the middle part, crossbolts, characterized in that:

the locking bolt (21) is assigned a pressure element:

the locking bolt (21) and the pressure element have corresponding first and second stop means, respectively for fixing the locking bolt (21);

an actuating means (22) for twisting the locking bolt (21) is of at least partially flexible configuration;

the locking bolt is assigned a reset element which acts against a direction of pull of the actuating means (22);

the reset element is configured as a second actuating means connected to the middle part (31) of the locking bolt (21); and the second actuating means is guided through the pressure element.

3. A coupling piece for the detachable connection of containers, especially of containers stacked one above the other on board ships, having a housing and a locking bolt mounted by a middle part rotatably in the housing, which locking bolt has, at opposite ends of the middle part, crossbolts, characterized in that:

the locking bolt (21) is assigned a pressure element:

the locking bolt (21) and the pressure element have corresponding first and second stop means, respectively, for fixing the locking bolt (21);

an actuating means (22) for twisting the locking bolt (21) is of at least partially flexible configuration;

the locking bolt is assigned a reset element which acts against a direction of pull of the actuating means (22); and the reset element is configured as a projection relative to a stop face (54) of the pressure element, which projection corresponds in such a way with a crosspiece (47) on the middle part (31) of the locking bolt (21), said crosspiece bearing stop faces (43, 44, 45), that, by twisting of the pressure element, the locking bolt (21) is able to be rotated back counter to the direction of pull of the actuating means (22).

* * * * *